US007753834B2

(12) United States Patent
Figgener et al.

(10) Patent No.: US 7,753,834 B2
(45) Date of Patent: Jul. 13, 2010

(54) SOLID-WALL CENTRIFUGE COMPRISING A WEIR PROVIDED WITH A STATIONARY ANGLED DEFLECTOR PLATE

(75) Inventors: Helmut Figgener, Oelde (DE); Markus Fleuter, Ennigerloh (DE); Ulrich Horbach, Hamm (DE); Ludger Horstkötter, Ennigerloh (DE); Martin Overberg, Herzebrock-Clarholz (DE); Stefan Terholsen, Oelde (DE)

(73) Assignee: Westfalia Separtator AG, Oelde (DE)

( * ) Notice: Subject to any disclaimer, the term of this patent is extended or adjusted under 35 U.S.C. 154(b) by 258 days.

(21) Appl. No.: 10/594,554

(22) PCT Filed: Mar. 31, 2005

(86) PCT No.: PCT/EP2005/003399

§ 371 (c)(1),
(2), (4) Date: Sep. 27, 2006

(87) PCT Pub. No.: WO2005/097336

PCT Pub. Date: Oct. 20, 2005

(65) Prior Publication Data

US 2008/0248940 A1 Oct. 9, 2008

(30) Foreign Application Priority Data

Apr. 6, 2004 (DE) ..... 20 2004 005 353 U

(51) Int. Cl.
*B04B 1/20* (2006.01)

(52) U.S. Cl. ..... 494/53; 494/56

(58) Field of Classification Search ..... 494/53, 494/54, 56, 57; 210/380.1, 380.3
See application file for complete search history.

(56) References Cited

U.S. PATENT DOCUMENTS

| | | | | |
|---|---|---|---|---|
| 2,083,899 | A | 6/1937 | Duerig | |
| 2,734,681 | A | 2/1956 | Schmiedel | |
| 4,313,559 | A * | 2/1982 | Ostkamp et al. | 494/38 |
| 5,593,377 | A * | 1/1997 | Figgener et al. | 494/56 |
| 2004/0058796 | A1 * | 3/2004 | Feldkamp et al. | 494/56 |

FOREIGN PATENT DOCUMENTS

| | | |
|---|---|---|
| DE | 706 968 | 6/1941 |
| DE | 966 080 | 7/1957 |
| DE | 25 15 452 | 10/1976 |
| EP | 0 702 599 B1 | 3/1996 |
| FR | 2 054 722 | 5/1971 |
| FR | 2 057 600 | 5/1971 |

(Continued)

*Primary Examiner*—Charles E Cooley
(74) *Attorney, Agent, or Firm*—Barnes & Thornburg LLP

(57) ABSTRACT

A solid-bowl centrifuge comprising, a centrifugal drum rotatable about a horizontal axis of rotation, the centrifugal drum including a weir to drain a liquid out of the centrifugal drum, the weir including a passage having at least one passage opening in an axial end region of the centrifugal drum that includes a drum lid: a deflector plate arranged outside the centrifugal drum and in front of the drum lid, the deflector plate being stationary during an operation of the centrifugal drum and widening at least in sections as the deflector plate extends away from the centrifugal drum: and the deflector plate including an interior jacket, and a distance of the interior jacket from the horizontal axis of rotation not being constant but widening.

21 Claims, 6 Drawing Sheets

FOREIGN PATENT DOCUMENTS

| | | | |
|---|---|---|---|
| FR | 2120537 | * | 8/1972 |
| JP | 11-179236 | * | 7/1999 |
| JP | 11197547 A | * | 7/1999 |
| WO | WO 01/85349 A1 | | 11/2001 |
| WO | WO 2005097336 A1 | * | 10/2005 |

* cited by examiner

SOLID-WALL CENTRIFUGE COMPRISING A WEIR PROVIDED WITH A STATIONARY ANGLED DEFLECTOR PLATE

BACKGROUND AND SUMMARY

The present disclosure relates to a solid-bowl centrifuge that includes a solid-bowl centrifuge, particularly a solid-bowl screw-type centrifuge, having a centrifugal drum rotatable about a horizontal axis of rotation, which has a weir for draining a liquid out of the centrifugal drum and which weir has a passage with at least one or more passage openings in an axial end region or drum lid characterized.

A solid-bowl centrifuge of the above-mentioned type is known from European Patent Document EP 0 702 599 B1 and U.S. Patent Document U.S. Pat. No. 5,593,377 respectively. These two documents disclose a solid-bowl screw-type centrifuge with a drum, having a weir which is provided with a passage for draining a liquid phase separated in the centrifugal drum, a throttle disk being assigned to the passage. The orifice plate is constructed as a non-rotating part whose distance to the passage is variable, so that an adjustment of the liquid level in the centrifugal drum becomes possible by an axial adjustment of the orifice plate.

The stationary orifice plate has no disadvantageous effect on the method of operation of the centrifugal drum. In particular, there is no disadvantageous braking effect as a result of the liquid passing through an annular gap between the rotating weir and the stationary liquid plate.

The annular gap generates a flow resistance which is greater the shorter the axial distance between the weir and the orifice plate. However, as the flow resistance increases, a greater fluid pressure is required at the passage, which leads to a rise of the liquid level in the centrifugal drum. When the axial distance between the weir and the orifice plate is enlarged, the liquid level in the centrifugal drum will fall to a value caused by the passage of the weir without such an orifice plate.

This solution has been very successful in practice because it can be implemented in a simple and cost-effective manner by a construction of the orifice plate which is stationary during an operation and does not rotate along with the drum. This is, without the necessity of transmitting adjusting forces to co-rotating parts of the centrifuge, and thereby makes it possible to excellently control and/or regulate the separation or clarification operation in the drum.

From International Patent Document WO 01/85349 A1, it is known to implement the axial adjustability of an orifice plate, which does not rotate along and whose method of operation corresponds to that of European Patent Document EP 0 702 599 B. The implementation is between the passage openings of the drum and the orifice plate in that the orifice plate can be swiveled in a flap-type manner about a pivot bearing at its outer circumference by an actuator. By a ring groove, which is called a "ring cup", the flow conditions at the passage are to be optimized. FIG. 1 herein suggests an embodiment in which a type of cylindrical ring having a wall, which is oriented parallel to the axis of rotation of the drum, is arranged in an annular gap between a stationary housing wall and the centrifuge lid, as well as adjustable apertures through which the drained liquid sprays directly radially to the outside, being arranged in this ring.

German Patent Document DE PS 966 080 shows a solid-bowl screw-type centrifuge whose liquid discharge from the drum is oriented radially to the outside, where the liquid is collected in a type of annulus having an almost circular cross-section. German Patent Document DE PS 706 968 also shows liquid discharges directed radially to the outside from the drum.

German Patent Document DE 25 15 452 also shows a plate behind the axially oriented liquid discharges, which plate rotates along with the drum and deflects the discharging liquid virtually by 180° into the opposite axial direction.

U.S. Pat. Document U.S. Pat. No. 2,083,899 shows a centrifuge with a vertical axis of rotation without an orifice plate.

French Patent Documents FR 20 57 600 and FR 20 54 722 each show solid-bowl screw-type centrifuges with a fluid discharge directed axially with respect to the axis of rotation, where emerging liquid can spray from a wall behind the outlets back again to the drum.

In contrast to the state of the art, as it is known from European Patent Document EP 0 702 599 B1, the present disclosure relates to a more careful discharge of the liquid phase from the weir in a simple manner.

Thus, the present disclosure relates to a solid-bowl centrifuge comprising a centrifugal drum rotatable about a horizontal axis of rotation. The centrifugal drum includes a weir to drain a liquid out of the centrifugal drum. The weir includes a passage having at least one passage opening in an axial end region of the centrifugal drum that includes a drum lid. A deflector plate is arranged outside the centrifugal drum and in front of the drum lid. The deflector plate is stationary during an operation of the centrifugal drum and widens at least in sections as the deflector plate extends away from the centrifugal drum. The deflector plate includes an interior jacket, and a distance of the interior jacket from the horizontal axis of rotation is not constant but widens.

Accordingly, a deflector plate, which is stationary during the operation, that is, does not rotate along with the drum, is arranged in front of the drum lid outside the centrifugal drum and inside a collecting chamber. The deflector plate extends away from the drum lid, widens at least in sections and has at least one interior jacket. A distance of the interior jacket from the axis of rotation is not being constant, but is widening or enlarging.

"Widening" means that the deflector plate is no plane plate but a "sleeve-type" component with an inside diameter which changes, for example, enlarges, at least over a portion of the axial dimension or the entire axial dimension. The deflector plate therefore has a defined axial dimension, as an extension of the axis of rotation of the drum, as well as an interior and exterior jacket. A distance of the interior jacket from the axis of rotation not being constant but being widened or enlarged.

The widening deflector plate has an opening angle $\gamma$ with respect to a plane extending perpendicularly to the axis of rotation D of the drum or parallel to the drum lid. Opening angle $\gamma$ is greater than 0° and smaller than 90°. The widening deflector plate at the interior jacket therefore has an angle of $90°-\gamma$ with respect to the axis of rotation (D) of the drum, which is greater than 0° and smaller than 90°.

The deflector plate has such a shape or is arranged or integrated in the arrangement such that the liquid first exits axially to the outside from the drum until it impacts on a wall or plate. From that impact, the liquid sprays essentially radially to the outside, the liquid arriving on the widening deflector plate which prevents the exiting liquid from directly radially impacting on a wall or walls, such as walls oriented parallel to the axis of rotation, of the collecting chamber. Thus, the development of noise is reduced in comparison to an arrangement without the deflector plate.

The liquid first exits axially, that is, parallel to the axis of rotation of the drum, from the drum to the outside until it impacts on a wall by which it is directed essentially radially to the outside. Here, it impacts on the widening deflector plate which prevents the exiting liquid from arriving at the drum again.

The widening geometry of the deflector plate has several advantages. For example, it permits a clear reduction of the operating noise of the centrifuge because the liquid sprays no longer directly from the annular gap between the orifice plate or another component and the drum lid against walls of the collecting chamber but is deflected by an angle which corresponds to the opening angle of the deflector plate. As a result, the liquid no longer arrives perpendicularly on the housing walls of the collecting chamber which clearly reduces the development of noise. In view of the high number of revolutions of, for example, 3,500 r.p.m., this is a significant advantage in practice.

In addition, because of the "softer" impacting of a liquid jet on the walls of the collecting chamber, the foam formation is reduced in the case of products with a tendency to foam.

Another advantage, for example, is a reduction of the power consumption by the initially fast drainage from the interior area, particularly away from the centrifugal drum surface.

An annular gap is formed between the passage and an orifice plate outside the centrifugal drum or between the passage and another component. The annular gap guides the liquid radially to the outside and the annular gap is completely or partially surrounded by the widening deflector plate over its axial dimension, so that the direct radial spraying of the liquid phase out of this annular gap is prevented. The deflector plate has an advantageous effect because it prevents the exiting liquid from impacting again on the drum.

The inside diameter of the deflector plate, for example, is larger than the outside diameter on which the passage openings of the centrifugal drum are arranged.

The deflector plate axially, for example, directly adjoins the passage openings, so that a flowing-out of liquid between the drum lid and the deflector plate is prevented. In another embodiment, projections, such as sleeves, which axially overlap the deflector plate, are provided at the passage openings.

The deflector plate has a ring-type, conically widening shape.

The opening angle of the interior jacket of the deflector plate, for example, amounts to between 5 and 45°, or between 10 and 30°. A clear minimizing of noise can be achieved by using one of the opening angle ranges just mentioned.

The opening angle of the deflector plate may be constant or may change over its axial dimension and/or in the circumferential direction.

A multipart, such as a two-part construction of the deflector plate is conceivable in order to implement its widening shape in a simple manner.

Other aspects of the present disclosure will become apparent from the following descriptions when considered in conjunction with the accompanying drawings.

DETAILED DESCRIPTION

Figure 1:
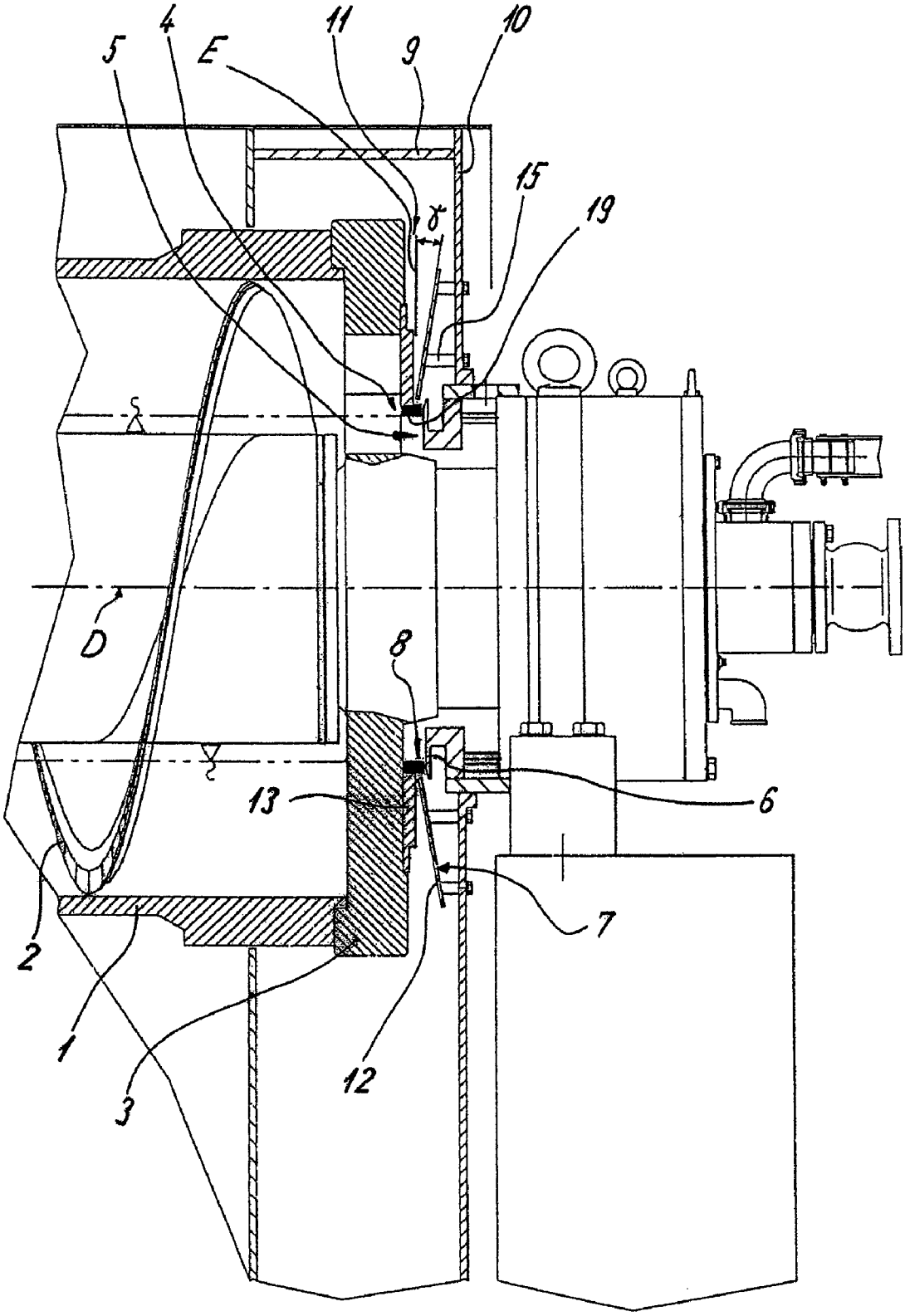
FIG. 1 is a sectional view of an axial end region of a solid-bowl centrifuge, according to the present disclosure, the centrifuge having a deflector plate.

FIG. 1 illustrates a solid-bowl centrifuge having a rotatable centrifugal drum 1 with a horizontal axis of rotation D, which solid-bowl centrifuge is constructed as a solid-bowl screw-type centrifuge. A rotatable screw 2 is also arranged in the centrifugal drum 1. A differential rotational speed generally is maintained between the centrifugal drum 1 and the screw 2 during an operation.

The centrifugal drum 1 is closed by an axial drum lid 3 which is equipped with at least one weir 4. The weir 4 is fixed or adjustable by shutters 13 for draining a liquid phase from the centrifugal drum.

The weir 4 comprises a passage with at least one or more passage openings 5 in the drum lid 3 as well as with an orifice plate 6 arranged outside the centrifugal drum 1 in front of the passage openings 5. The orifice plate 6 is constructed as a part which does not rotate along during the operation and whose distance from the passage openings 5 is variable. Here, a collar-type projection 19 of the weir 4 protrudes axially from the drum lid 3. This can be implemented, for example, by sleeves in or at the passage openings 5 or by a ring or a second shutter of a different diameter.

The changing of the axial distance between the passage openings 5 and the orifice plate 6 can take place, for example, by an axial movement by displacing or swiveling the orifice plate 6 in front of the passage openings 5, for example, by actuators. To this extent, the construction may correspond to the state of the art referred to above.

In contrast to the state of the art, a deflector plate or deflector sleeve 12 of a ring-type construction is assigned to the orifice plate 6. The deflector plate 12 has, for example, a conical shape, the deflector plate 12 covering the ring gap 8, for example, over its entire length and widening away from the passage openings 5. The deflector plate 12 has a radially innermost edge upstream of the passage opening 5 of the weir 4 such that liquid exiting the drum 1 is directed away from the drum lid 3.

An opening angle $\gamma$ of the interior jacket 7 of the deflector plate 12 relative to a perpendicular line with respect to the axis of rotation D of the drum or with respect to a plane E extending parallel to an end surface of the drum lid 3, amounts to between 5° and 45° or between 10° and 30°.

The opening angle $\gamma$ may be constant over an entire radial and axial dimension of the deflector plate 12. However, it may also change suddenly or continuously, for example, at a bend from 15° to 20°.

The liquid flowing out of an annular gap 8 to the outside places itself against the deflector plate 12 and is deflected by the deflector plate 12. The liquid essentially impacts at an angle $\gamma$ smaller than 90° on walls 9, 10 of a collecting chamber 11 surrounding the orifice plate 6, for draining the liquid. This also results in a clear reduction of noise during the operation.

A multipart, for example, a two-part construction of the deflector plate 12 is conceivable in order to implement the widening shape of the deflector plate 12 in a simple manner.

Figure 2:
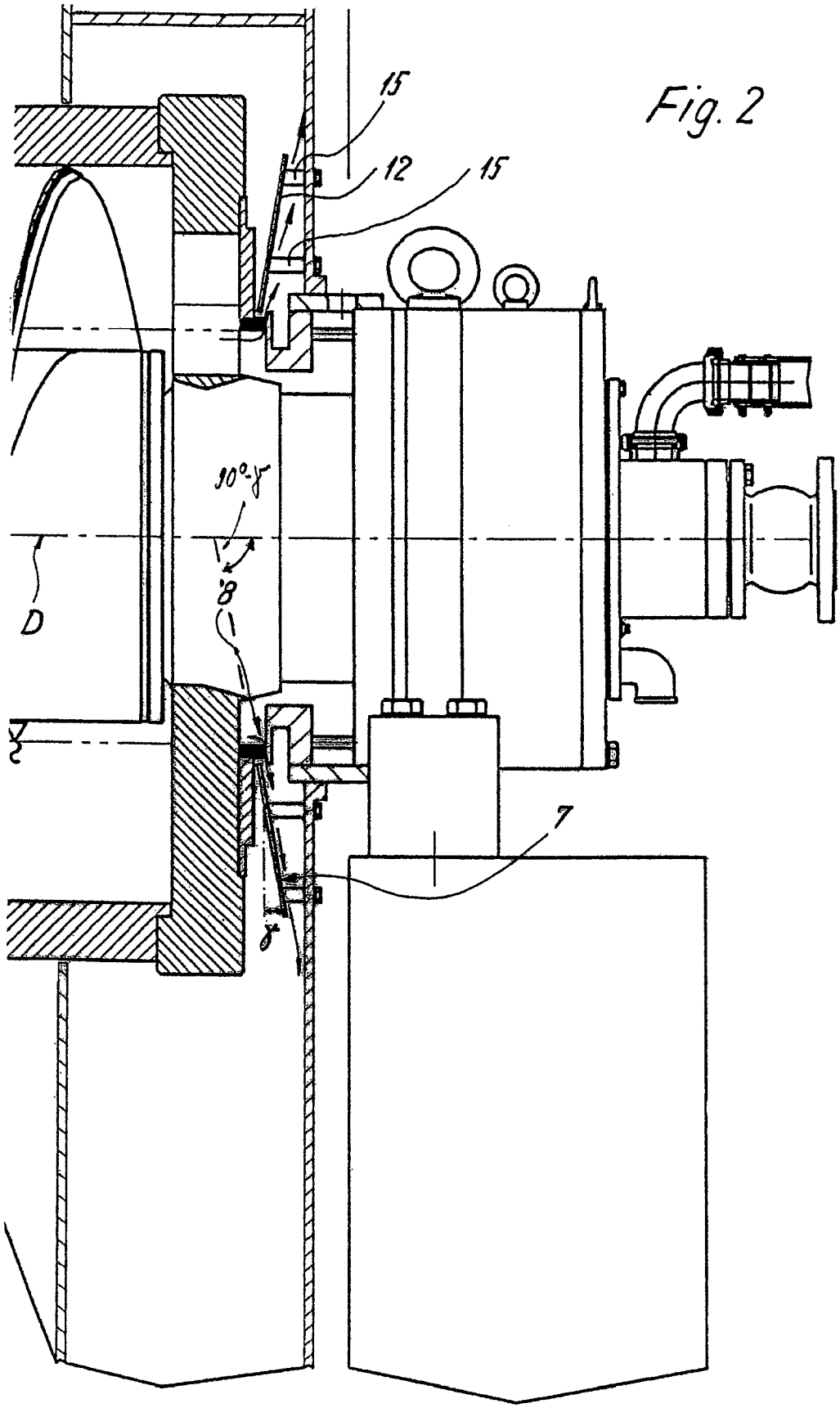
FIG. 2 is an enlarged cut-out view of FIG. 1 showing an example of flow conditions.

Optimized flow conditions, for example, are illustrated in FIG. 2.

Optimized drainage from the annular gap 8, for example, is visible while avoiding a direct flowing-out of the liquid in the radial direction. The liquid therefore no longer impacts on the wall 9 of the collecting chamber 11 which wall 9 extends essentially parallel to the axis of rotation D. The noise development is thereby reduced, which is an advantage in view of a usage range at drum diameters of more than 500 mm. Noise limit values are more easily observed at higher rotational speeds. Power losses are also avoided if the liquid no longer impacts on the drum 1 or a bearing hub after having exited the bearing hub.

The opening angle γ is selected such that the wall 9 on the outside on the collecting chamber 11 is not reached directly by the exiting product or liquid jet.

A spiral casing geometry of the deflector plate 12, similar to a spiral casing of centrifugal pumps is conceivable (not shown).

Figure 3:
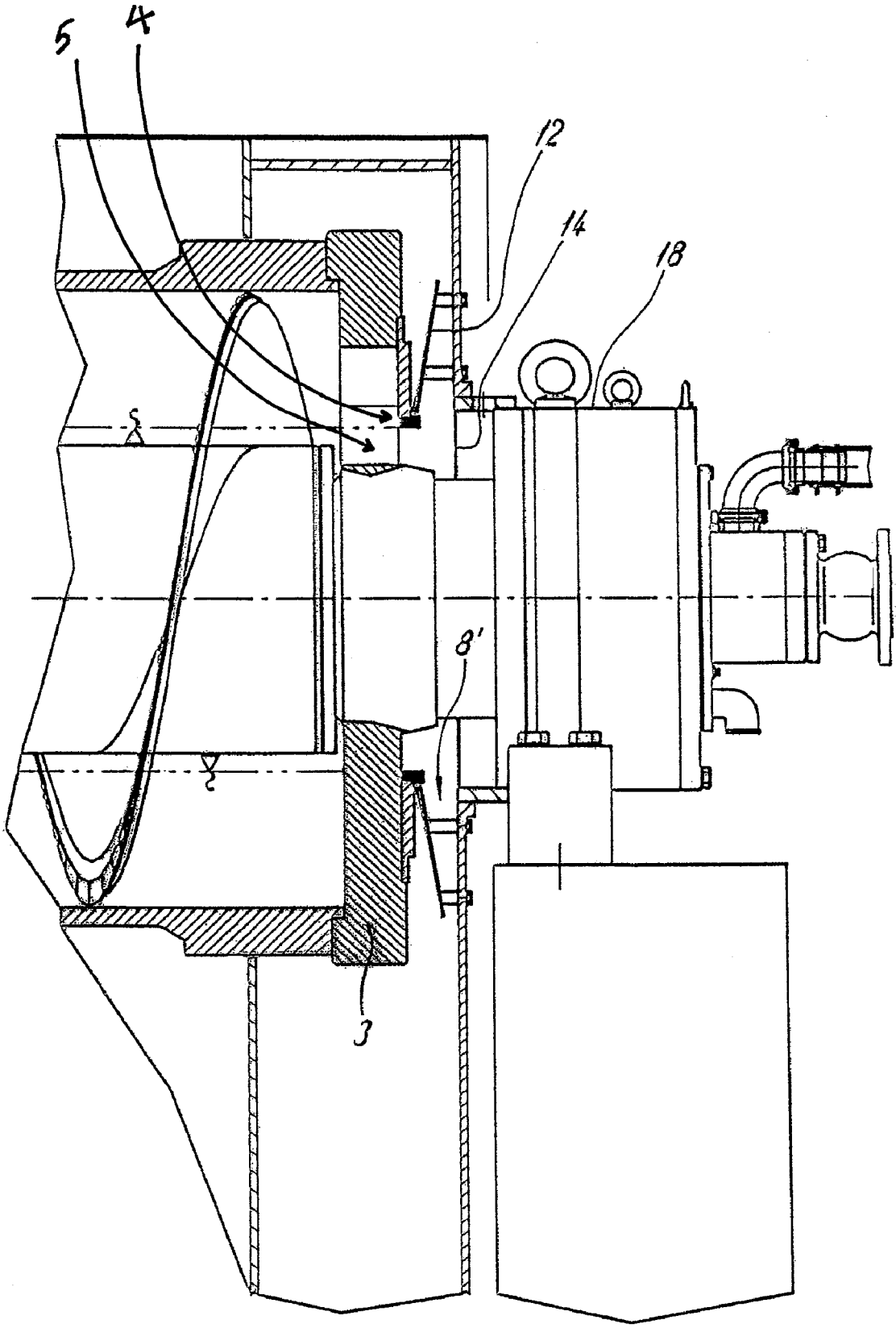
FIG. 3 is a sectional view of an axial end region of a second embodiment of a solid-bowl centrifuge, according to the present disclosure.

As shown in FIG. 3, the weir 4 comprises the passage openings 5 in the drum lid 3 but no orifice plate 6. On the contrary, the liquid flows directly against another component, for example, a ring plate 14 in front of or on a transmission housing 18. The transmission housing 18 is constructed as a part which does not rotate along during the operation. The annular gap 8', which is partially covered here toward the outside by the deflector plate 12, is constructed between the drum lid 3 and the ring plate component 14. The deflector plate 12 has a radially innermost edge upstream of the passage opening 5 of the weir 4 such that liquid exiting the drum 1 is directed away from the drum lid 3.

Figure 4:
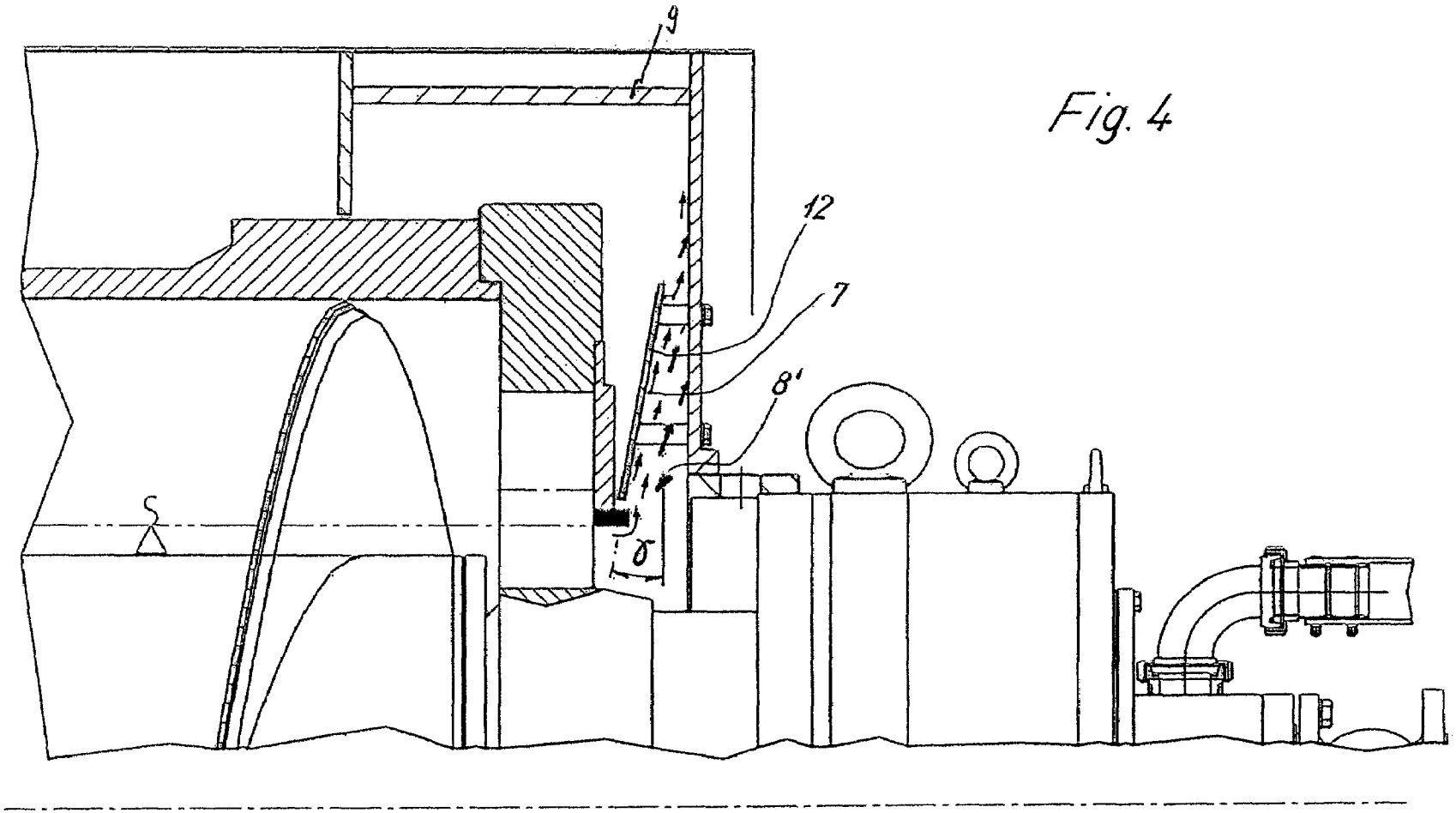
FIG. 4 is an enlarged cut-out view of FIG. 3 showing in example of flow conditions.
Figure 5:
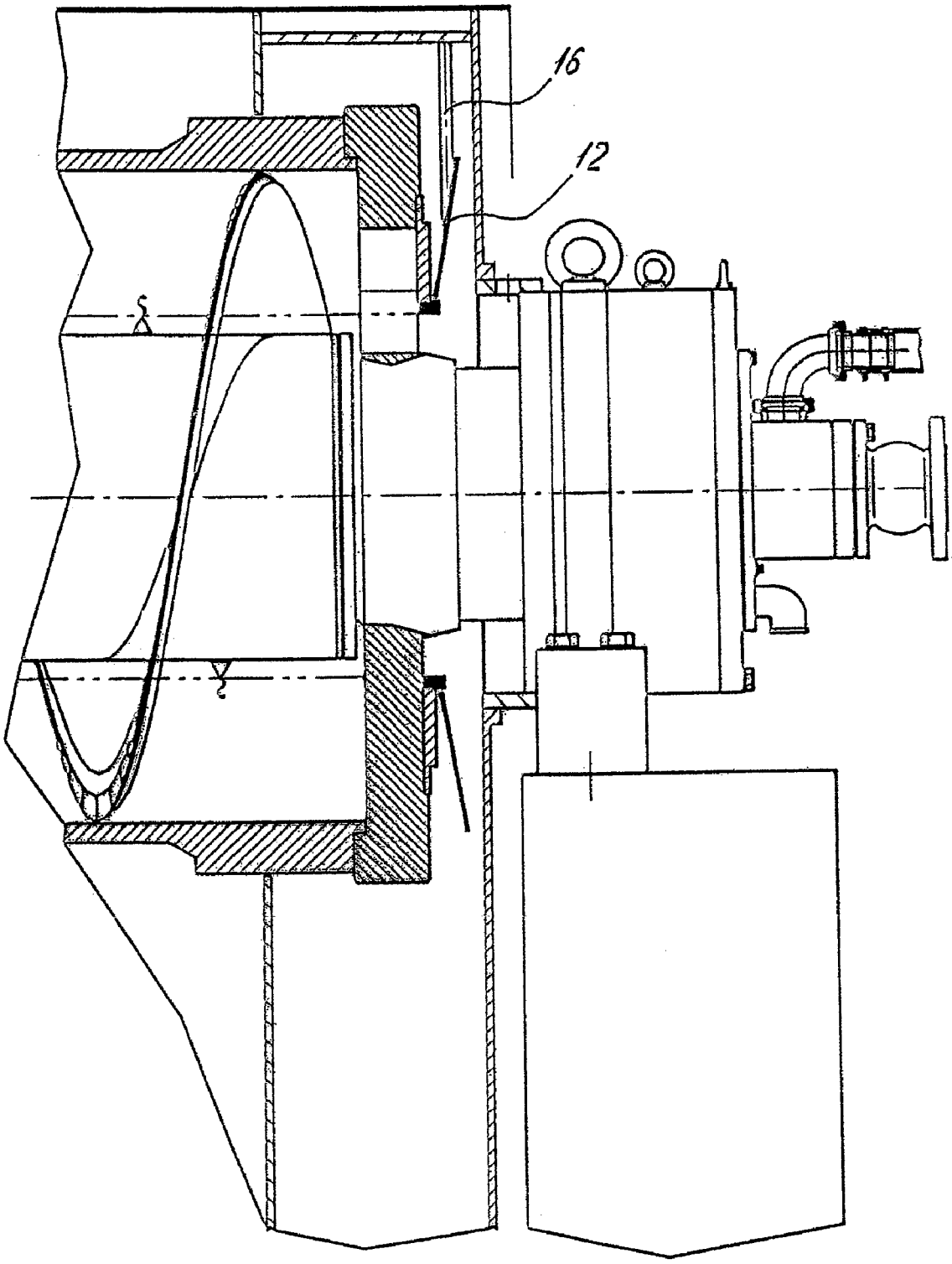
FIG. 5 is a sectional view of and axial end region of a third embodiment of a solid-bowl centrifuge, according to the present disclosure, showing an alternative fastening of the deflector plate as compared to the embodiment of FIG. 3.

Optimized flow conditions are shown in FIG. 4 in a manner similar to FIG. 2. The deflector plate 12 may also have a dimension which is larger than illustrated in the figures relative to the axial length of the annular gap 8'.

Figure 6:
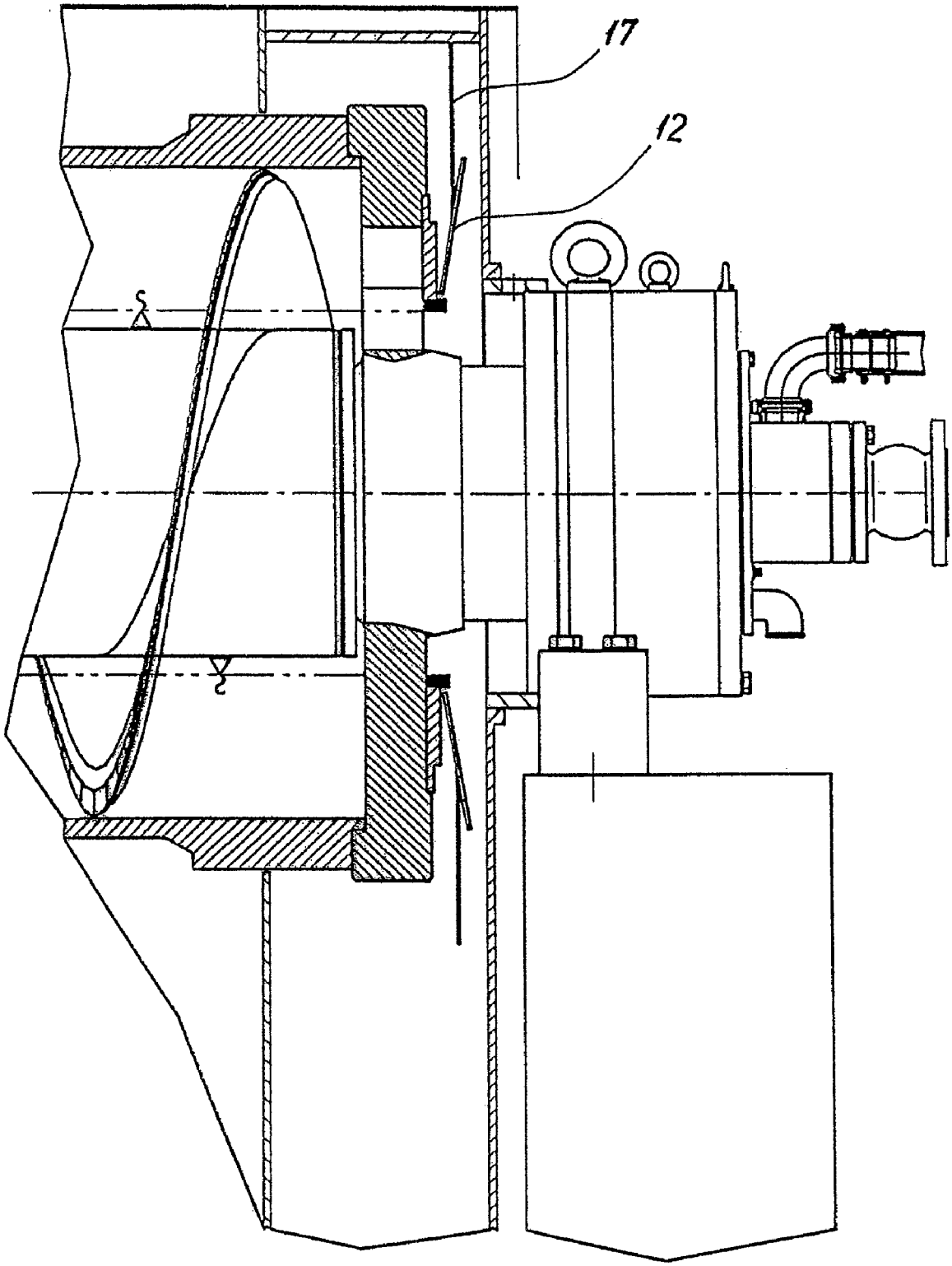
FIG. 6 is a sectional view of an axial end region of a fourth embodiment of a solid-bowl centrifuge, according to the present disclosure, showing an alternative fastening of the deflector plate as compared to the embodiment of FIG. 3.

A fastening of the deflector plate 12 made, for example, of one or more metal plates, may be by bolts 15 or 16 in an axial (see FIGS. 1 and 3) or radial (see FIG. 4) orientation. The bolts 15, 16 may extend from surrounding walls 9 or 10 to the deflector plate 12. The fastening may be by a stabilizing plane ring 17 between the exterior jacket of the deflector plate 12 and the wall 9 (see FIG. 6).

The arrangement of the fastening bolts 15, 16 or of the fastening ring 17 in the radial direction reduces the risk of its erosion because it is arranged virtually in a turbulent region of the deflector plate 12. The number of fastening bolts 15, 16 may vary and may include at least three.

Although the present disclosure has been described and illustrated in detail, it is to be clearly understood that this is done by way of illustration and example only and is not to be taken by way of limitation. The scope of the present disclosure is to be limited only by the terms of the appended claims.

The invention claimed is:

1. A solid-bowl centrifuge comprising:

a centrifugal drum rotatable about a horizontal axis of rotation, the centrifugal drum including a weir to drain a liquid out of the centrifugal drum, the weir including a passage having at least one passage opening in an axial end region of the centrifugal drum that includes a drum lid;

an annular deflector plate arranged outside the centrifugal drum and in front of the drum lid, the deflector plate being stationary during an operation of the centrifugal drum and widening at least in sections as the deflector plate extends away from the centrifugal drum; and the deflector plate including an interior jacket and having a radially innermost edge upstream of the at least one passage opening of the weir such that liquid exiting the drum is directed away from the drum lid, and a distance of the interior jacket from the horizontal axis of rotation not being constant but widening.

2. The solid-bowl centrifuge according to claim 1, wherein an annular gap is formed between the weir and an orifice plate outside the centrifugal drum, which annular gap is one of completely and partially surrounded over its axial dimension by the widening deflector plate.

3. The solid-bowl centrifuge according to claim 1, wherein on the interior jacket, the widening deflector plate has an opening angle γ with respect to a plane extending perpendicular to the horizontal axis of rotation, which opening angle γ is greater than 0° and smaller than 90°.

4. The solid-bowl centrifuge according to claim 3, wherein the opening angle γ of the deflector plate is between 5 and 45°.

5. The solid-bowl centrifuge according to claim 3, wherein the opening angle γ of the deflector plate is between 10 and 30°.

6. The solid-bowl centrifuge according to claim 3, wherein the opening angle γ of the deflector plate is constant.

7. The solid-bowl centrifuge claim 3, wherein the opening angle γ of the deflector plate changes over one of its axial dimension and in a circumferential direction.

8. The solid-bowl centrifuge according to claim 3, wherein the opening angle γ of the deflector plate changes one of continuously and suddenly, and is enlarged over an axial dimension of the deflector plate.

9. The solid-bowl centrifuge according to claim 1, wherein the deflector plate has a conically widening shape.

10. The solid-bowl centrifuge according to claim 1, wherein the liquid first flows axially to an outside from the centrifugal drum until the liquid impacts on one of a wall and plate, from which the liquid essentially sprays radially to the outside and impacting upon the widening deflector plate which prevents the exiting liquid from arriving directly radially on walls of a collecting chamber.

11. The solid-bowl centrifuge according to claim 1, wherein the widening deflector plate at the interior jacket has an angle of 90°−γ with respect to the axis of rotations of the centrifugal drum, which angle is greater than 0° and smaller than 90°.

12. The solid-bowl centrifuge according to claim 1, wherein a smallest inside diameter of the deflector plate is larger than an outside diameter on which the at least one passage opening is arranged.

13. The solid-bowl centrifuge according to claim 1, wherein the deflector plate axially directly adjoins the at least one passage opening.

14. The solid-bowl centrifuge according to claim 1, wherein a projection which protrudes axially from the drum lid, is formed at the at least one passage opening, the deflector plate axially overlapping the projection.

15. The solid-bowl centrifuge according to claim 1, wherein the deflector plate includes multiparts.

16. The solid-bowl centrifuge according to claim 1, wherein a distance between the at least one passage opening and an orifice plate is variable.

17. The solid-bowl centrifuge according to claim 1, further comprising a rotatable screw arranged in the centrifugal drum.

18. The solid-bowl centrifuge according to claim 1, wherein the deflector plate is fastened to a surrounding wall by in an axial orientation.

19. The solid-bowl centrifuge according to claim 1, wherein the deflector plate is fastened to a surrounding wall by in a radial orientation.

20. The solid-bowl centrifuge according to claim 1, wherein the deflector plate is fastened to a surrounding wall by a ring.

21. The solid-bowl centrifuge of claim 1, wherein an annular gap is formed between the weir and a ring plate outside the centrifugal drum, which annular gap is one of completely and partially surrounded over its axial dimension by the widening deflector plate.

* * * * *